US005447571A

United States Patent [19]

Kuchner et al.

[11] Patent Number: 5,447,571

[45] Date of Patent: Sep. 5, 1995

[54] CLEANING METHOD FOR PULVERIZED COAL INJECTION SYSTEM EQUIPMENT USING COKE BREEZE

[75] Inventors: Robert A. Kuchner, N. Canton; Peter H. Scheuler, Richfield; Jerald M. Wennerstrom, Canal Fulton, all of Ohio

[73] Assignee: The Babcock & Wilcox Company, New Orleans, La.

[21] Appl. No.: 206,990

[22] Filed: Mar. 7, 1994

[51] Int. Cl.[6] ..... B08B 9/02

[52] U.S. Cl. ..... 134/7; 451/37; 451/39; 451/40

[58] Field of Search ..... 134/7, 22.12, 22.18; 51/317, 319, 320; 75/460; 266/44, 47, 135, 136

[56] References Cited

U.S. PATENT DOCUMENTS 4,065,322 12/1977 Langford et al. ..... 134/7

4,428,769 1/1984 Limpach et al. ..... 75/460

*Primary Examiner*—David A. Simmons
*Assistant Examiner*—Sean Vincent
*Attorney, Agent, or Firm*—Robert J. Edwards; Michael L. Hoelter

[57] ABSTRACT

A method of cleaning, either continuously or intermittently, a pneumatically operated pulverized coal system by injecting into this system a stream of generally uniformly sized coke breeze particles. This coke breeze stream would abrade the interior surface of the pulverized coal system thereby cleaning it. Additionally, due to the high carbon content of the coke breeze, this substance will replace or displace a portion of the coal stream delivered to the furnace. Furthermore, such use of coke breeze will eliminate the need to dispose of this by-product in cases where alternative uses are not available.

12 Claims, 2 Drawing Sheets

CLEANING METHOD FOR PULVERIZED COAL INJECTION SYSTEM EQUIPMENT USING COKE BREEZE

FIELD OF THE INVENTION

This invention pertains to the process of pneumatically injecting pulverized coal into a furnace or the like and more particularly to the cleaning of these lines so as to prevent any deposit build-up therein.

BACKGROUND OF THE INVENTION

Many industries use pulverized coal as the main source of fuel in their furnaces and/or boilers. Additionally, the steel industry supplies pulverized coal to its blast furnaces in an effort to both reduce the amount of coke that normally would be consumed there and to replace other combustible fuels which might otherwise be used as its heat source.

Generally, such pulverized coal is supplied to the furnace or boiler via a pneumatic injection system. Additionally, in the steel industry, it is common for such a pneumatic injection system to incorporate a mixture of both air and nitrogen as the conveying medium. Thus, this gaseous air/nitrogen mixture is used to convey the coal to each blast furnace tuyere or nozzle so it can be burned with the furnace hot blast.

Unfortunately, however, it has been found that during such operation, deposits of fine coal built up on the inside surface of these pulverized coal delivery lines and also on the inside surface of related equipment such as tubing, nozzles, reservoirs, and the like. It has also been found that when certain coals were used, this internal buildup increased dramatically thereby severely reducing the ability to deliver pulverized coal to the furnace.

In the past, attempts to rectify this problem have included the specification of the use of only certain coals which exhibit a low deposition rate. However, over time, deposits may still occur. Other attempts have included frequent air/nitrogen purging of the system or the use of shot cleaning with steel balls or other materials to dislodge the deposits. A more extreme solution involves the disassembly of the system and the manual cleaning of its various components. Because the cleaning methods noted are only temporarily effective, they must be repeated frequently. Each such cleaning cycle interrupts operations thereby further increasing their overall cost to the industry. On the other hand, by electing to continue to operate with a partially clogged delivery system, power requirements will increase and system capacity may be reduced which results in a significant economic penalty.

Another problem faced by steel producers is the need to dispose of significant quantities of an operational by-product referred to as coke breeze. Coke breeze is a granular, carbon based substance that is generated in the coke production and handling process. This material is unsuitable for charging into the blast furnaces of steel mills because of its small particle size. One of the largest uses for coke breeze has been in iron ore sintering plants where the coke breeze is mixed with the iron ore and other constituents as a source of energy for the sintering process. However, because these same sintering plants have been the source of significant particulate and gaseous emissions, many of them have closed or are now shutdown. Consequently, the demand for coke breeze for use in sintering plants has diminished, thereby causing excess coke breeze to become a disposal problem.

It is thus an object of the present invention to provide an economical means of cleaning pulverized coal delivery lines. Another object of the present invention is to provide a means of either continuously cleaning such lines or intermittently cleaning them, as desired. Yet another object of the present invention is to provide a means of cleaning a pulverized coal injection system without any interruption of the ongoing operations. A further object of this invention is to provide a means of cleaning whose effectiveness can be monitored through variations in injecting pressure requirements. Still another object of the present invention is to clean such lines through abrasion using granular coke breeze. Yet another object of this invention is to equip facilities utilizing a pulverized coal injection system with a means of disposing of excess coke breeze. A further object of this invention is to dispose of the excess coke breeze by burning it thereby also making use of its high carbon content. These and other objects and advantages will become obvious upon further investigation.

SUMMARY OF THE INVENTION

What is disclosed is a method of cleaning the interior surface of a pulverized coal injection system which includes the step of generating a generally uniformly sized coke breeze particle stream and then delivering this coke breeze particle stream to a pulverized coal injection system. Such an injection system would incorporate a generally uniformly sized pulverized coal stream that would be mixed with the injected coke breeze particle stream, thereby forming a coke breeze/-pulverized coal stream. Afterwards, this coke breeze/-pulverized coal stream would be pneumatically transported to a furnace during which time the coke breeze particle stream component would scour the interior surface of the pulverized coal injection system.

DETAILED DESCRIPTION OF THE DRAWINGS

The following is a description of the use of coke breeze as an additive to a typical pulverized coal injection system so as to scour and/or abrade away any deposits that may occur within the system.

Figure 1:
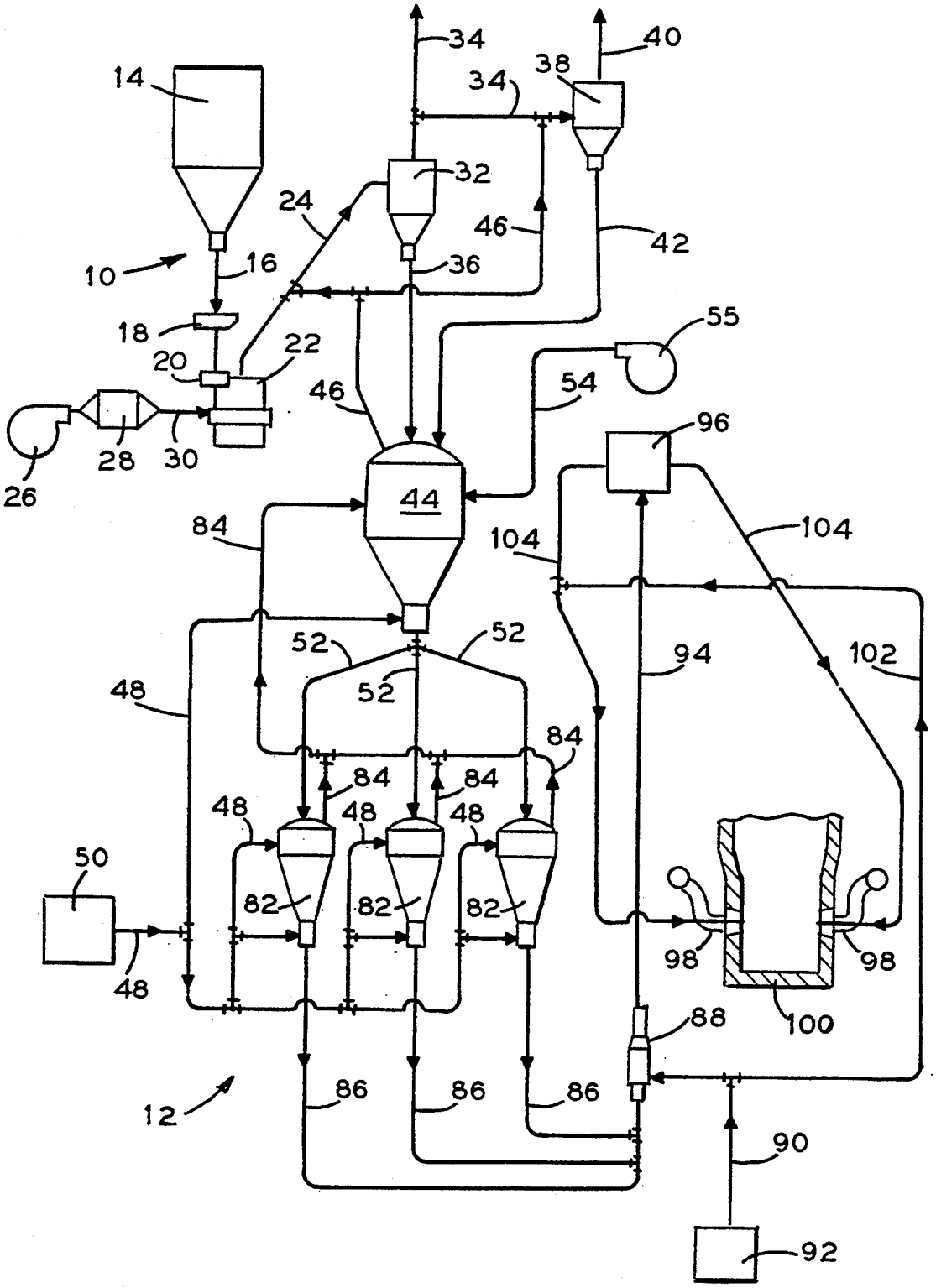
FIG. 1 is a schematic diagram of both the coal preparation portion and the coal injection portion of a typical pulverized coal delivery system illustrating only a few of the various components involved.

Referring initially to FIG. 1, there is shown an example of a typical pulverized coal preparation system 10 along with downstream pulverized coal injection system 12. Coal preparation system 10 can be said to begin at one or more raw coal bunkers 14 where the raw coal 16 therein may have previously been screened and/or magnetically separated.

This raw coal 16 is discharged from these various raw coal bunkers 14 via coal gates 18 that permit such coal 16 to pass onto feeders 20. These feeders 20 deliver raw coal 16 to pulverizers 22 which pulverize this coal 16 into a generally uniform mass of similarly sized particles 24. Fans 26 and air heaters 28 supply dry primary air 30 to pulverizers 22 so as to dry the raw coal 16 in pulverizers 22 and to convey this pulverized coal 24 to one or more cyclone collectors 32.

Cyclone collectors 32 separate the incoming pulverized coal stream 24 into a first stream 34 containing all of the carrier gas along with mostly small, fine particles (vent stream) and a second stream 36 containing the larger heavy particles (particulate or pulverized coal stream). First stream 34 can be vented to the atmosphere as shown, but this stream 34 is normally delivered to one or more filter house modules 38 which further separate this first stream 34 into a clean gas stream 40 and a fine solids (pulverized coal) stream 42. Clean gas stream 40 is vented as shown while both fine solids stream 42 and second stream 36 from cyclone collectors 32 are transported to reservoir 44. It should be noted that some pulverized coal preparation systems 10 do not utilize a .cyclone collector 32 and instead route pulverized coal stream 24 directly to filter house module 38.

Reservoir 44 is also vented via line 46 which can be coupled to pulverized coal stream 24 just upstream cyclone collectors 32 or vent line 46 can be coupled directly into one or more filter modules 38. A fluidizing medium 48 is injected into reservoir 44 from its source 50 so as to generate a discharge stream 52 from reservoir 44. Ideally, fluidizing medium 48 would consist solely of $N_2$ gas, or another inert gas to establish and maintain an inert atmosphere in reservoir 44. This inert atmosphere eliminates the possibility of spontaneous fire or explosion of the pulverized coal contained in reservoir 44. Fluidizing medium 48 will also act to fluidize the contents of reservoir 44 so as to facilitate the smooth flow of discharge stream 52.

It is at this stage that coke breeze via line 54 can be introduced into pulverized coal injection system 12 of FIG. 1. This can be accomplished by delivering coke breeze stream 54 directly to reservoir 44 via pneumatic pump 55 at controlled rates so as to become subsequently mixed with the incoming pulverized coal via lines 36 and/or 42. An alternate method involves combining raw coke breeze or coke breeze stream 54 at controlled rates with raw coal 16 entering one or more coal bunkers 14. This latter method would utilize coal preparation system 10 as the means to pulverize, dry, and separate the coke breeze in combination with the main coal stream.

As stated earlier, coke breeze is a by-product generated by the coke production and handling process in the steel industry. It is a course, granular, abrasive, high carbon-content material that would be generally unsuitable as the sole injectant in a pulverized coal injection system for feeding blast furnaces because it contains no volatile matter and would not combust adequately in the blast furnace raceway. Furthermore, its abrasive characteristics would result in rapid wear in the pneumatic conveying and distribution lines to the point that system reliability and/or maintenance costs would become unacceptable.

Figure 2:
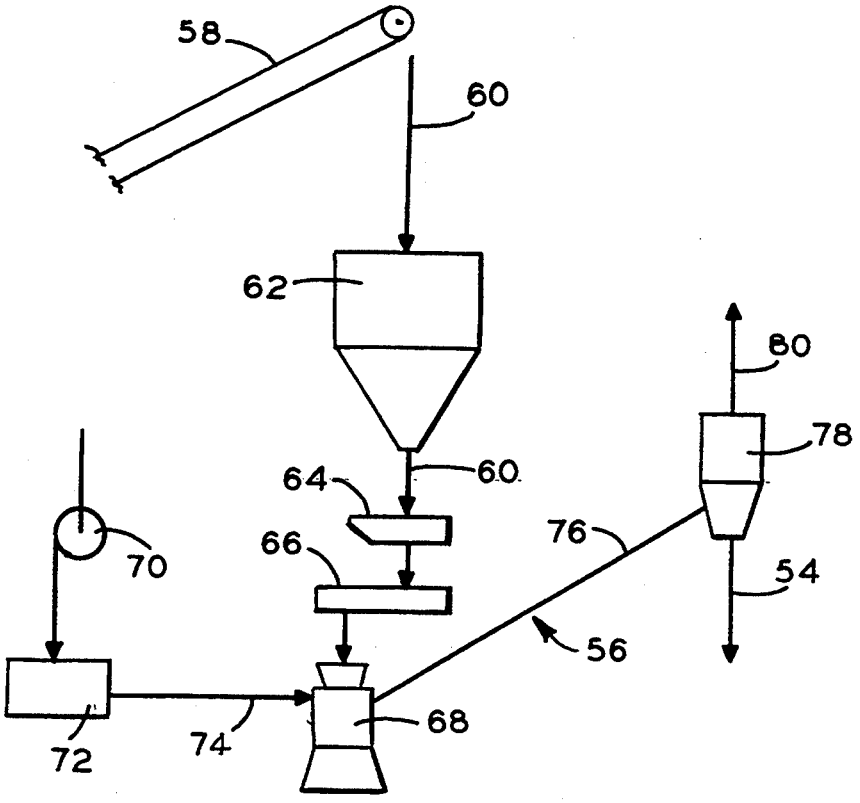
FIG. 2 is a schematic diagram of a supplemental coke breeze preparation system which delivers pulverized and dried coke breeze to the pulverized coal injection system illustrated in FIG. 1.

Coke breeze preparation system 56 as shown in FIG. 2 can be said to begin with coke breeze conveyor 58 which transports raw coke breeze 60 to coke breeze bunker 62. (Generally, a coke breeze screen is not required since coke breeze is usually a pre-screened material.) Coke breeze gate 64 and a coke breeze feeder 66, each located downstream bunker 62, control the amount of raw coke breeze 60 delivered to coke breeze pulverizer 68. It should be noted that pulverizer 68 is optional depending upon the granular size of raw coke breeze 60. If such raw coke breeze 60 has been prescreened or pulverized to an acceptable size and shape and has been pre-dried to an acceptably low level of moisture, then pulverizer 68 is not needed. However, should raw coke breeze 60 contain significant quantities of large particles and/or if coke breeze 60 contains significant free moisture, then pulverizer 68 will be warranted.

A coke breeze primary air fan 70 and a coke breeze primary air heater 72 supply pre-heated air 74 to pulverizer 68 as the transport and drying medium for pulverized coke breeze stream 76. This stream 76, which consists of a combination of dry air and properly sized coke breeze, can then be pneumatically delivered to filter 78 where the conveying and drying air 74 will be separated from the pulverized coke breeze. The separated conveying and drying air 74 is preferably discharged to the atmosphere through vent 80 while the collected pulverized coke breeze is discharged through line 54 to reservoir 44 via pneumatic pump 55 or elsewhere as discussed above. It is within reservoir 44 that the mixing of coke breeze 54 with the pulverized coal from lines 36 and 42 occurs.

It is also possible to deliver coke breeze stream 54 to other locations of pulverized coal preparation system 10 and/or injection system 12 (such as to a conveyor or into an existing line.) as may be desired, the location described above merely being for example's sake. Another method of preparing coke breeze (pulverized and dried) for introduction into a pulverized coal preparation system 10 is to prepare the coke breeze at a remote facility similar to coke breeze preparation system 56. Afterwards, this prepared coke breeze can be delivered via bulk transport methods such as by truck, rail, or pneumatic pipeline, directly into reservoir 44 or into a coke breeze holding bin and thence into reservoir 44 or elsewhere.

Discharge stream 52 from reservoir 44 (which consists primarily of coke breeze, pulverized coal, and gases) is then delivered to one or more feed tanks 82 as shown. Each such feed tank 82 generally incorporates vent line 84 that can be vented to reservoir 44 as shown.

Supply header 48 also introduces a nitrogen gas (or a similar inert gas) into pulverized coal injection system 12 from source 50. This nitrogen would typically first be pressurized via compressors (not shown) and then subsequently delivered to high pressure nitrogen accumulator (not shown). Such nitrogen may then be delivered directly to feed tank 82 for pressurizing and fluidizing purposes, the fluidizing nitrogen entering feed tank 82 via supply header lines 48. Afterwards, stream 86 is discharged from these feed tanks 82 with stream 86 being a combination of coke breeze, pulverized coal, and nitrogen. This mixture 86 is then delivered to pick up 88 where stream 86 is further mixed with transport air 90. Air compressors and air receiver 92 deliver such transport air 90 to pick up 88 as well as to other adjacent blast furnace equipment.

The discharge from pick up 88, or dilute phase coal transport 94, is then delivered to distributor 96 for subsequent conveyance to one or more tuyeres or nozzles 98 of blast furnace 100. Additionally, prior to the delivery to tuyeres 98, purging or sealing air 102 from air source 92 can also be introduced into lines 104 as needed.

By utilizing the above pulverized coal preparation system 10 and pulverized coal injection system 12, which incorporates the use of coke breeze stream 54, the operators are able to both dispose of the excess coke breeze by-product while still making use of its high elemental carbon and energy components. This process enables the operators to dispose of this by-product via the pulverized feed system for blast furnace 100.

Another advantage of combining pulverized coal with coke breeze is the decrease in deposits in the pneumatic transport conduits even when using coals that are known to deposit heavily. As can be imagined, any build-up of deposits in the conveyance system will decrease the effectiveness and efficiency of this system thereby requiring more power and pressure to feed furnace 100. Additionally, by using coke breeze stream 54 to continuously scour the conduit system, a larger variety of coals can now be used which might allow for less expensive and/or more effective coals to be utilized. Furthermore, it is also possible to only intermittently use coke breeze stream 54 to scour pulverized coal injection system 12 if such is desired. This can be accomplished by only intermittently operating system 56 of FIG. 2.

Furthermore, by using coke breeze, its high carbon content can replace or displace some of the coal previously used within furnace 100. Additionally, by so utilizing the coke breeze, its associated disposal costs are either no longer incurred or they are reduced. In other words, instead of disposing of this by-product as a waste, it is now being utilized both as a source of fuel and as an additive to clean or maintain the various components of the pneumatic conveyance system. The effectiveness of such cleanliness, or the need to clean such components, can be monitored by system pressure or power measurements. Also, by incorporating coke breeze as indicated, there is no need to interrupt or disrupt ongoing operations since these deposits can be delivered directly to the furnace for burning.

Alternatives to the use of coke breeze to clean the pneumatic lines of pulverized coal injection system 12 include (a) periodic off-line purging; (b) periodic shot cleaning of the system with steel balls or particles; (c) periodic switching of the type of coal used; and, (d) disassembly of the system for the mechanical cleaning thereof. None of these alternatives is attractive since they merely address the symptom of the problem and not the problem itself, which is to continuously maintain the cleanliness of the system.

While it was stated earlier that coke breeze stream 54 could be injected into pulverized coal injection system 12 at locations other than as shown in FIG. 1, it is also possible to inject such coke breeze stream 54 directly into feed tanks 82 if such is desired.

What is claimed is:

1. A method of cleaning the interior surface of a pulverized coal injection system comprising the steps of:

(a) generating a generally uniformly sized coke breeze particle stream;

(b) delivering said coke breeze particle stream to a pulverized coal injection system, said injection system comprising a generally uniformly sized pulverized coal fuel stream;

(c) mixing said coke breeze particle stream with said pulverized coal fuel stream thereby forming a coke breeze/pulverized coal fuel stream;

(d) pneumatically transporting said coke breeze/pulverized coal fuel stream to a furnace for the fueling thereof; and, (e) continuously removing fuel stream deposition from the interior surface of said pulverized coal injection system by said coke breeze/pulverized coal fuel stream during the operation of said furnace.

2. The method as set forth in claim 1 further comprising the step of injecting a nitrogen containing gas into said coke breeze/pulverized coal fuel stream prior to transporting said coke breeze/pulverized coal fuel stream to said furnace.

3. The method as set forth in claim 2 further comprising the step of pneumatically delivering said coke breeze particle stream to said pulverized coal injection system.

4. The method as set forth in claim 3 further comprising the step of collecting said coke breeze/pulverized coal fuel stream in one or more reservoirs prior to delivery to said furnace.

5. The method as set forth in claim 4 further comprising the step of fluidizing said coke breeze/pulverized coal fuel stream in said one or more reservoirs with a nitrogen containing gas.

6. The method as set forth in claim 5 further comprising the step of using compressed air to pneumatically transport said coke breeze/pulverized coal fuel stream to said furnace.

7. The method as set forth in claim 6 further comprising the step of initially pulverizing raw coke breeze thereby generating said uniformly sized coke breeze particle stream.

8. The method as set forth in claim 6 wherein said step of delivering said coke breeze particle stream to a pulverized coal injection system comprises the step of delivering said coke breeze particle stream to said one or more reservoirs.

9. The method as set forth in claim 6 wherein said step of delivering said coke breeze particle stream to a pulverized coal injection system comprises the step of delivering said coke breeze particle stream to a pneumatic pump.

10. The method as set forth in claim 6 wherein said step of delivering said coke breeze particle stream to a pulverized coal injection system comprises the step of delivering said coke breeze particle stream to one or more raw coal bunkers, said raw coal bunkers forming a part of said pulverized coal injection system.

11. The method as set forth in claim 6 further comprising the step of continuously injecting said coke breeze particle stream into said pulverized coal injection system.

12. The method as set forth in claim 6 further comprising the step of intermittently injecting said coke breeze particle stream into said pulverized coal injection system.

* * * * *

UNITED STATES PATENT AND TRADEMARK OFFICE

CERTIFICATE OF CORRECTION

PATENT NO. : 5,447,571
DATED : September 5, 1995
INVENTOR(S) : Robert A. Kuchner, et. al.

It is certified that error appears in the above-indentified patent and that said Letters Patent is hereby corrected as shown below:

Title page, item [75], inventor: the second named inventor's correct last name is "Schueler".

Signed and Sealed this

Second Day of July, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,447,571

DATED : September 5, 1995

INVENTOR(S) : Robert A. Kuchner, Peter H. Schueler & Jerald M. Wennerstrom

It is certified that error appears in the above-identified patent and that said Letters Patent is hereby corrected as shown below:

On the title page, the second named inventor's correct last name is "SCHUELER".

Signed and Sealed this

Seventeenth Day of June, 1997

*Attest:*

Bruce Lehman

BRUCE LEHMAN

*Attesting Officer*

*Commissioner of Patents and Trademarks*